US005886617A

United States Patent [19]

Meloche et al.

[11] Patent Number: 5,886,617

[45] Date of Patent: Mar. 23, 1999

[54] COMPOSITE TUBE TRANSDUCER CYLINDER

[75] Inventors: Joseph L. Meloche, Bryan, Ohio; Gordon M. Day, Winston-Salem, N.C.

[73] Assignee: Ingersoll-Rand Company, Woodcliff Lake, N.J.

[21] Appl. No.: 877,824

[22] Filed: Jun. 18, 1997

[51] Int. Cl.[6] ..... H01C 10/38

[52] U.S. Cl. ..... 338/176

[58] Field of Search ..... 338/164, 176, 338/183, 184, 233

[56] References Cited

U.S. PATENT DOCUMENTS

| | | | |
|---|---|---|---|
| 3,335,385 | 8/1967 | Mower et al. | 338/116 |
| 3,726,191 | 4/1973 | Johnston et al. | 92/5 R |
| 3,996,550 | 12/1976 | Yano | 338/183 |
| 4,039,916 | 8/1977 | Selam | 318/587 |
| 4,053,865 | 10/1977 | Brown, Jr. | 338/180 |
| 4,479,107 | 10/1984 | Bleeke | 338/176 |
| 4,523,514 | 6/1985 | Burk et al. | 92/5 R |
| 4,552,055 | 11/1985 | Foxwell | 92/5 R |
| 4,583,032 | 4/1986 | Nunziata et al. | 318/666 |
| 4,656,457 | 4/1987 | Brausfeld et al. | 338/176 |
| 4,680,570 | 7/1987 | Hehl | 338/176 |
| 4,872,396 | 10/1989 | Wimbush et al. | 29/169.1 |
| 4,879,440 | 11/1989 | Lymburner | 200/82 R |
| 5,072,206 | 12/1991 | Kozuka et al. | 338/184 |
| 5,103,172 | 4/1992 | Stoll | 324/226 |
| 5,166,628 | 11/1992 | Henninger | 324/723 |
| 5,291,176 | 3/1994 | Fujita | 338/125 |

*Primary Examiner*—Teresa Walberg
*Assistant Examiner*—Jeffrey Pwu
*Attorney, Agent, or Firm*—Walter C. Vliet; Leon Nigohosian, Jr.

[57] ABSTRACT

A composite tube transducer cylinder is manufactured from molded material in which embedded strips of resistive and conductive material are exposed to the inside surface and wherein a piston operating within the cylinder may make contact between a conductive and a resistive strip as a means for determining piston position.

9 Claims, 4 Drawing Sheets

COMPOSITE TUBE TRANSDUCER CYLINDER

BACKGROUND OF THE INVENTION

This invention relates generally to linear actuator motors and more particularly to devices for determining the position of a piston within a cylinder.

In many applications, such as package sizing, quality control, lane diversion on a conveyor system, etc., the exact position of the end of a fluid power cylinder rod is desired in order to control the process at hand. Until recently, this had been accomplished by attaching a linear transducer to the side of the cylinder in parallel and coupling the two rods. As the cylinder extended, the transducer rod would also be drawn out and a voltage proportional to cylinder rod position would be produced.

Recently, several manufacturers have endeavored to package the transducer within the cylinder itself. This is accomplished using a hollow rod and placing a rail with conductive and resistive strips inside the hollow rod and attaching it to the blind end of the cylinder. A sliding contact within the piston would make electrical connection between these strips and a voltage proportional to cylinder rod position would be generated. There are several disadvantages to this existing method; the cost of drilling the length of cylinder rod is prohibitive, the size of available transducers limits this type of technology to only larger cylinder bores, and a different length transducer, and thus a unique part, is necessary for each of the many different cylinder strokes available.

The foregoing illustrates limitations known to exist in present position indicating cylinders. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a composite tube transducer cylinder comprising a tubular cylinder constructed of non-conducting composite material having a selectable axial length and an internal bore of a given internal bore diameter; the tubular cylinder being further provided with a pair of molded in parallel axis axial conductors exposed for contact on the internal bore; and a movable piston disposed in sliding contact with the internal bore and the movable piston is further provided with a contact conducting between the parallel axis axial conductors.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
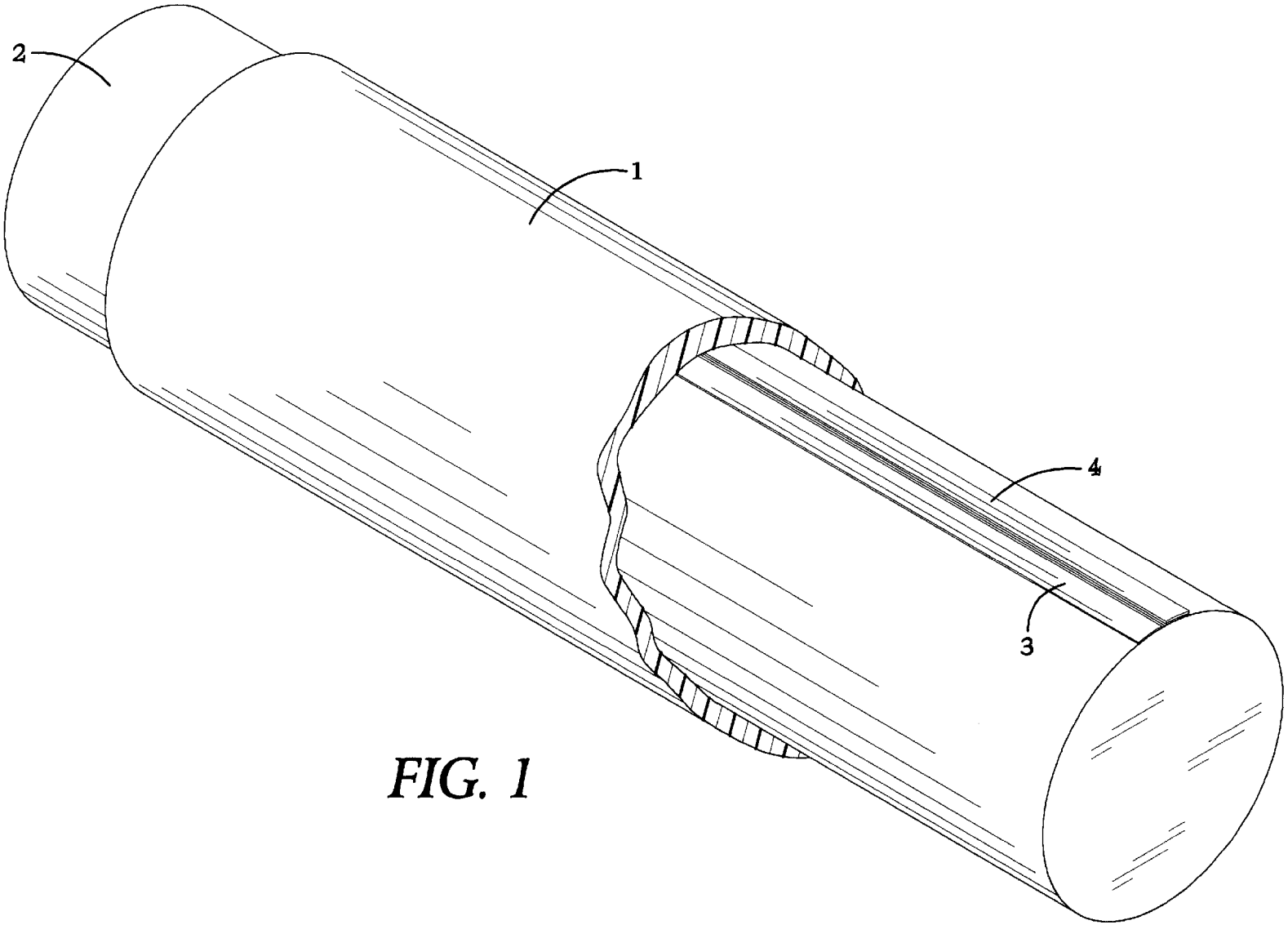
FIG. 1 is a partial cut-away schematic showing the construction and method of construction for a transducer cylinder according to the present invention.

FIG. 1 shows a method of forming a composite tube transducer cylinder 1 on a mandrel 2. The conductive strips 3 and 4 and the resistive strip 5 are laid axially on the mandrel and the tubing material is molded and wound about it. The resulting tubing 1 contains the embedded strips which are exposed to the inside diameter 6 of the tubing.

Figure 2:
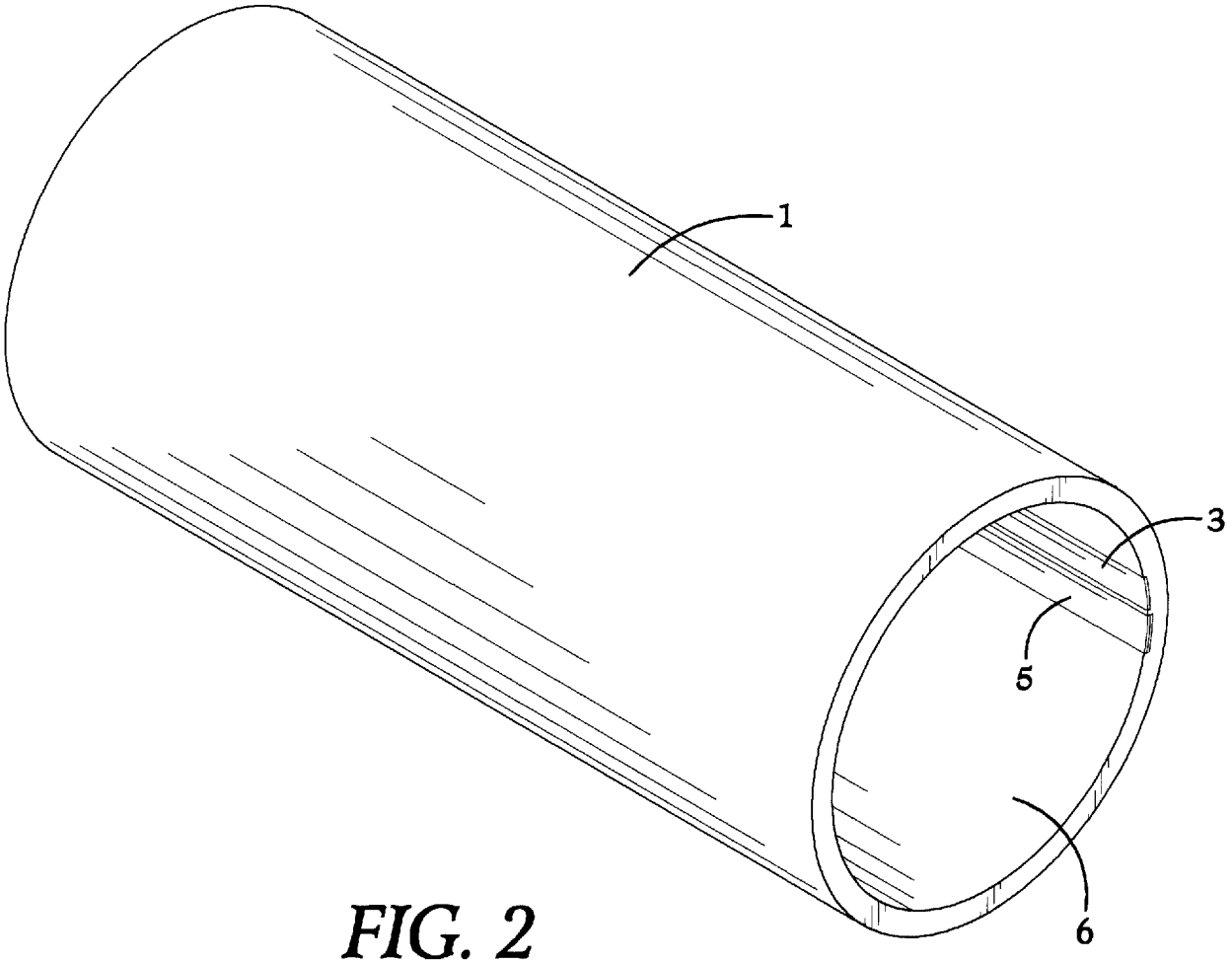
FIG. 2 is an isometric view of a transducer cylinder according to the present invention.

FIG. 2 shows the completed tube product.

Figure 3:
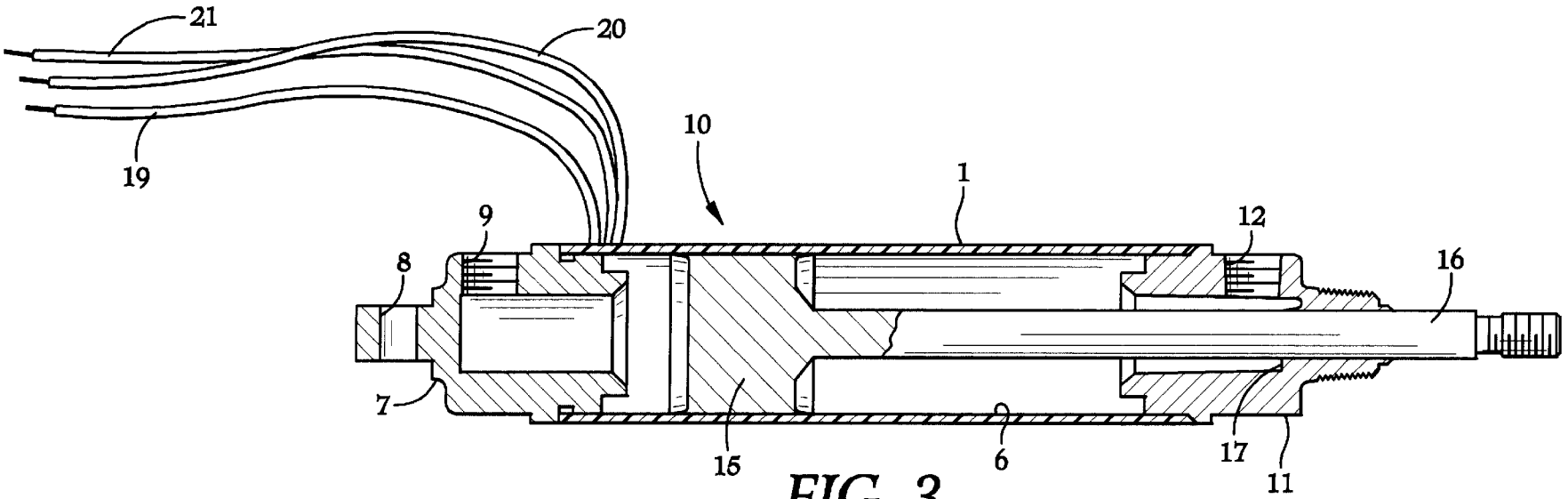
FIG. 3 is a cross section of an assembled transducer cylinder in a linear actuator.

FIG. 3 shows an assembly drawing in cross section of a linear actuator generally designated by the reference numeral 10 according to the present invention.

The composite tube cylinder 1 is provided with a back end cap 7 having attachment point 8 and a pressure fluid inlet 9. The composite tube cylinder 1 is further provided with a front end cap 11 having a return pressure fluid 12. Disposed within the cylinder for reciprocation therein is a piston 15 having a solid piston rod 16 which extends out through the front end cap 11 through appropriate seals 17. Lead wires 19, 20, and 21, extend from the conductive and resistive strips.

Figure 4:
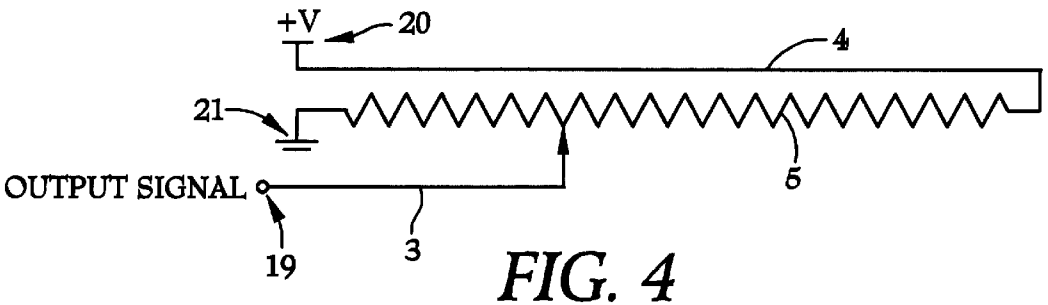
FIG. 4 is a schematic of the resistive locating circuit of the present invention.
Figure 5:
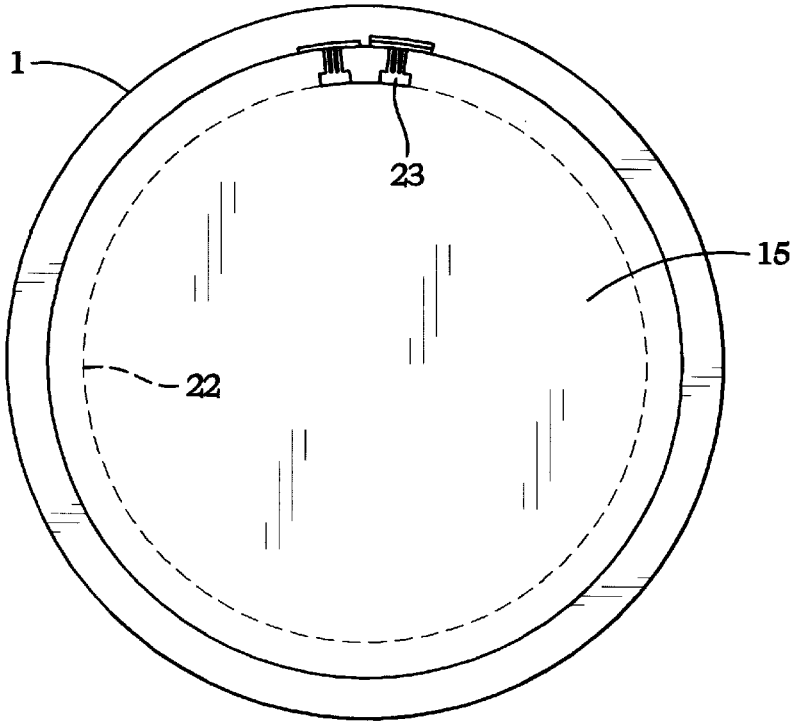
FIG. 5 is an end view of the transducer cylinder and an inserted piston showing the method of contact.
Figure 6:
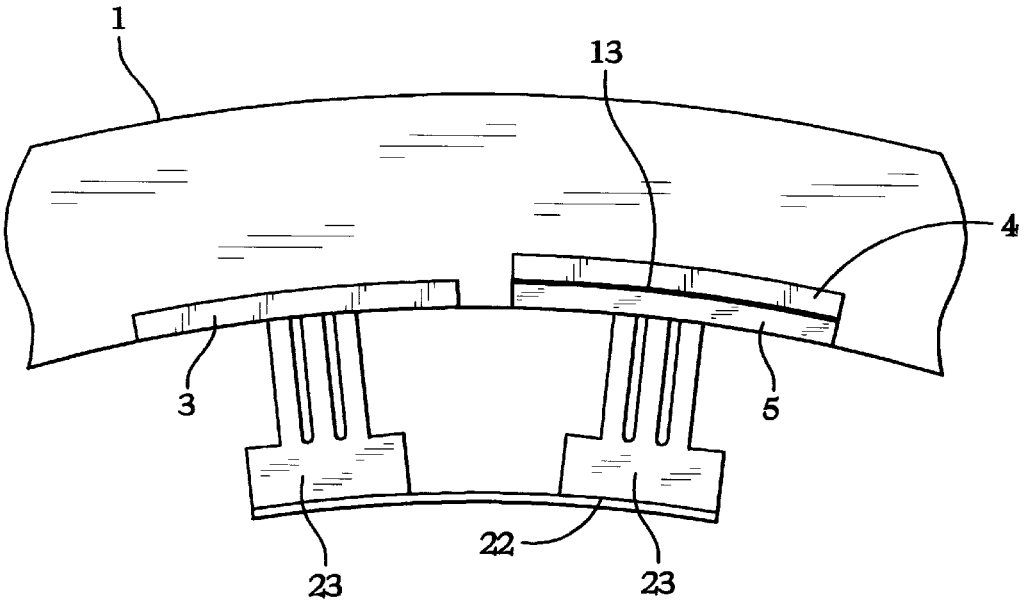
FIG. 6 is a detailed view of the contact between the piston and cylinder.

A ring 22, best seen in FIG. 6, containing contacts 23, is attached to the piston 15 and extends around the piston. The contacts 23 make shunting contact between the resistive strip 5 and the conductive strip to produce a voltage signal proportional to the cylinder position. As best seen in the exploded view of FIG. 6, resistive strip 5 and conductive strip 4 are electrically insulated from each other by an insulating layer 13. Upon cutting the composite tube cylinder to length as discussed below, the ends of resistive strip 5 and conductive strip 4 (i.e., the ends which are opposite the attachment point of lead wires 21 and 20, respectively) are electrically connected, preferably by soldering, to create the electrical circuit shown by the schematic of FIG. 4. This signal is converted to a position signal by electrical means, not shown but well understood in the art for potentiometer readings and the like. One of the major advantages of the construction of the present invention is that the composite tube cylinder may be manufactured in any length and cut to size for a given cylinder stroke. When the cylinder tubing is cut to the stroke length desired by the customer, wires are soldered to the strips and the cylinder is assembled, as shown in FIG. 3.

Having disclosed our invention in terms of a preferred embodiment, numerous other alternatives will occur to one skilled in the art. We do not wish to be limited in the scope of our invention except as claimed.

What is claimed is:

1. A composite tube transducer cylinder and sliding piston combination comprising:

a tubular cylinder constructed of non-conducting composite material having a selectable axial length and an internal bore of a given internal bore diameter;

said tubular cylinder being further provided with a pair of molded in parallel axis axial conductors exposed for contact on said internal bore; and a movable piston disposed in sliding contact with said internal bore and said movable piston is further provided with a contact conducting between said parallel axis axial conductors.

2. A composite tube transducer cylinder and sliding piston combination according to claim 1 wherein:

said tubular cylinder and movable piston form part of a linear actuating cylinder.

3. A composite tube transducer cylinder and sliding piston combination according to claim 1 wherein:

one of said parallel axis axial conductors is a resistive conductor.

4. A composite tube transducer cylinder and sliding piston combination according to claim 1 wherein:

said contact on said movable piston is a circular ring contact between said parallel axis axial conductors.

5. A composite tube transducer cylinder and sliding piston combination according to claim 1 wherein:

the position of said movable piston within said tubular cylinder is determined by a resistance path length on said parallel axis axial conductors.

6. A composite tube transducer cylinder and sliding piston combination according to claim 1 wherein:

said tubular cylinder is manufactured of moldable composite plastic material.

7. A composite tube transducer cylinder and sliding piston combination according to claim 1 wherein:

said tubular cylinder is fitted with end caps.

8. A composite tube transducer cylinder and sliding piston combination according to claim 1 wherein:

said movable piston is attached to a solid piston rod.

9. A composite tube transducer cylinder and sliding piston combination according to claim 8 wherein:

said parallel axis axial conductors are provided with lead wires which exit one end of said tubular cylinder.

* * * * *